United States Patent [19]

Feldman

[11] Patent Number: 5,018,236

[45] Date of Patent: May 28, 1991

[54] ROLLER-TYPE PAINT APPLICATOR

[76] Inventor: Martin Feldman, 88 Barnes St., Long Beach, N.Y. 11561

[21] Appl. No.: 511,258

[22] Filed: Apr. 19, 1990

[51] Int. Cl.[5] ..... B05C 17/02

[52] U.S. Cl. ..... 15/230.11; 29/110.5

[58] Field of Search ..... 15/230.11; 29/110.5, 29/120

[56] References Cited

U.S. PATENT DOCUMENTS 4,829,623 5/1989 Brezette et al. ..... 15/230.11

4,896,394 1/1990 Linn et al. ..... 15/230.11

FOREIGN PATENT DOCUMENTS 842455 5/1970 Canada ..... 15/230.11

*Primary Examiner*—Edward L. Roberts

*Attorney, Agent, or Firm*—Terry M. Gernstein

[57] ABSTRACT

A roller-type paint applicator includes a housing that is held in the palm of a user's hand and has wings that protect the hands and fingers of the user from paint. A roller is supported in the housing.

1 Claim, 2 Drawing Sheets

ROLLER-TYPE PAINT APPLICATOR

TECHNICAL FIELD OF THE INVENTION

The present invention relates to the general art of hand tools, and to the particular field of roller-type paint applicators.

BACKGROUND OF THE INVENTION

In the construction or remodeling of buildings, it is often desirable or necessary to provide various surfaces with one or more coats of paint. These surfaces are often easily accessible, such as room walls, or the like; however, in some instances, these surfaces are quite difficult to reach, such as in small closet areas, or the like. Often, application of paint is a time consuming job which can be strenuous on the painter's back, neck, arms and legs. This situation is exacerbated if much of the job must be carried out in confined areas.

Many paint jobs are carried out using roller-type paint applicators. However, such applicators do not always lend themselves to use in small, confined areas. The handles on such applicators may inhibit, or even prevent, their use in such confined areas. This situation may force the painter to assume awkward positions thereby increasing the strain on his body.

While small roller-type applicators, such as disclosed in U.S. Pat. No. 2,985,902, ameliorate the situation somewhat, even these small applicators do not fully meet the problem of muscle fatique since the paiinter must still use a handle which can get in the way or require that painter to apply force to the roller through a moment arm that is ineffectively oriented.

Therefore, there is a need for a roller-type paint. applicator assembly which can be used in small, confined areas and which can be used without exerting undue strain on the user's muscles.

OBJECTS OF THE INVENTION

It is a main object of the present invention is to provide a roller-type paint applicator assembly which can be used in small, confined areas.

It is another object of the present invention to a roller-type paint applicator assembly which which can be used in small, confined areas and which can be used without exerting undue strain on the user's muscles.

SUMMARY OF THE INVENTION

These, and other, objects are achieved by a roller-type paint applicator that omits the handle normally associated with such applicators. The applicator includes a housing having a J-shaped roller support element thereon, and the user holds the housing in the palm of his hand to apply paint.

In this manner, the applicator can be used in small, confined areas and there is no hinderance to such use by a handle. Still further, the roller is not operated through a long moment arm, and thus the problems that might be associated with such long moment arms will be avoided. Since the applicator is held directly in the user's hand, the applicator is comfortable and can be controlled easier than if a long arm were used.

BRIEF DESCRIPTION OF THE DRAWING FIGURES

DETAILED DESCRIPTION OF THE PREFERRED EMBODIMENT OF THE INVENTION

Figure 1:
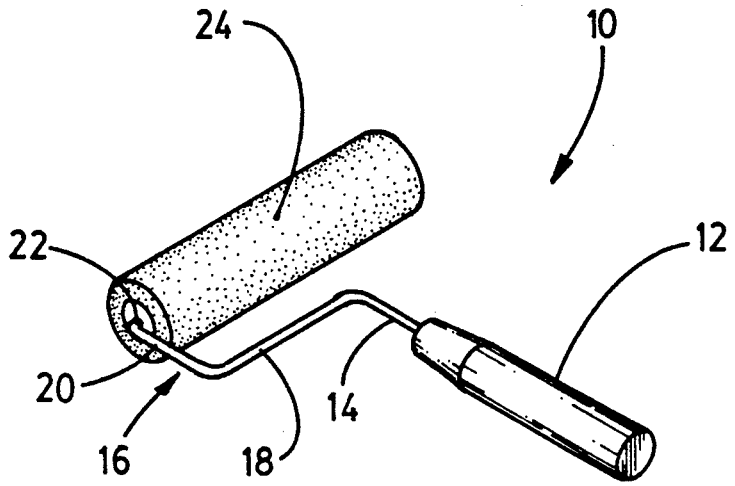
FIG. 1 is a perspective view of a roller-type paint applicator embodiment the prior art.

Roller-type paint applicators, such as applicator 10 shown in FIG. 1, have heretofore included a handle 12, mounted on one end of an arm 14 and a U-shaped roller support section 16 located at the other end of the arm 14. The roller support section 16 includes a first leg 18 attached at one end to the arm 14 and attached at another end to a bight section 20. The bight section is attached to a second leg 22 that extends essentially parallel to the first leg 18. A paint-applicator roller 24 is mounted on the second leg to rotate about that second leg.

As discussed above, the handle portion of the applicator 10 often gets in the way and acts as a hinderance to the application process, especially if the job must be carried out in a small, confined area.

Figure 2:
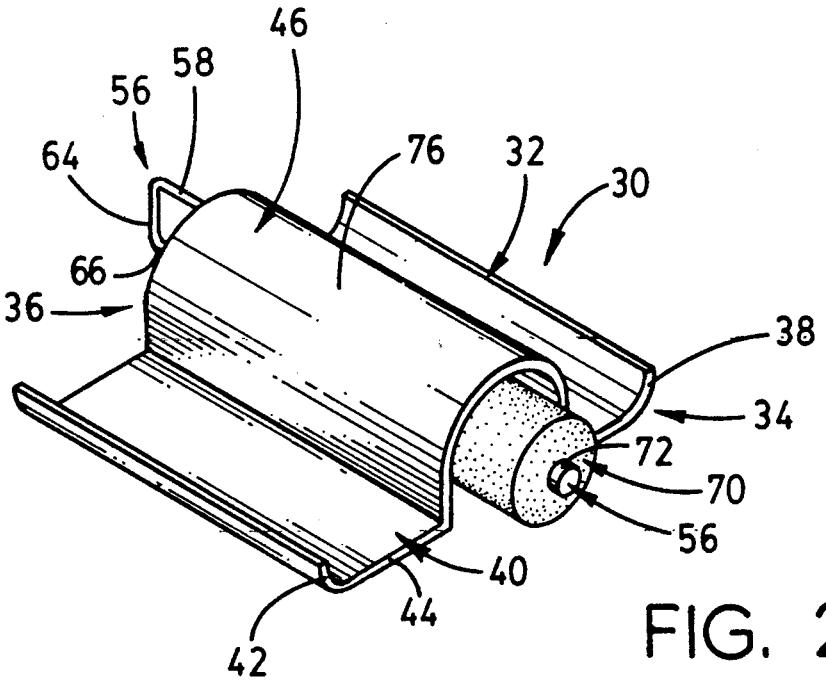
FIG. 2 is a perspective view of a roller-type paint applicator embodiment the present invention.
Figure 3:
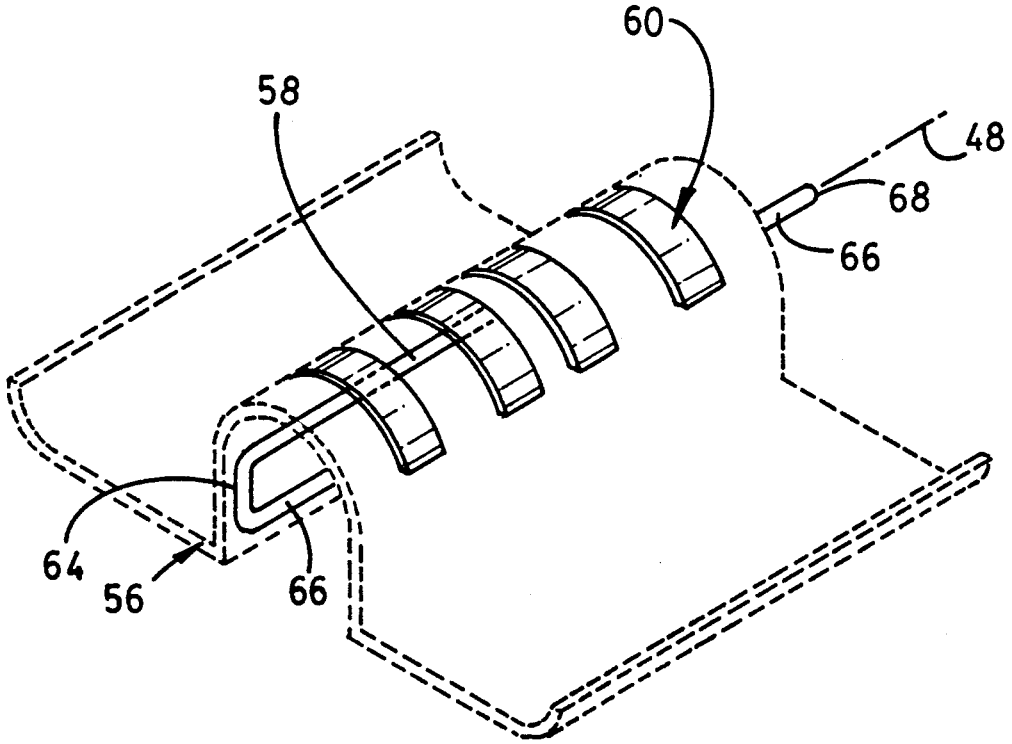
FIG. 3 is a perspective view of the roller-type paint applicator of the present invention showing a detail thereof.

Shown in FIGS. 2 and 3 is a roller-type paint applicator 30 embodying the present invention and which does not require the use of a handle to apply paint.

The applicator 30 includes a monolithic housing 32 which is grasped by the user and held in the palm of his hand to apply paint.

The housing includes a first end 34 and a second end 36, and two L-shaped wing sections 38 and 40 each of which has a short leg 42 and a long leg 44. The housing also includes a semi-cylindrical cylindrial central section 46 that has a longitudinal centerline 48 and has two side edges 50 and 52. The wing sections are located and positioned so that both of the long legs 44 are coplanar with each other, and the wing sections terminate at ends that are coplanar with the end of the central section. The long legs are attached to the central section and extend outwardly therefrom so that the long legs lie between that central housing and the short legs.

A monolithic J-shaped roller support element 56 is supported on the housing to be located inside the central section. The element 56 includes a short leg 58 that is located on top of the central section and is extends beyond the housing end 36 as indicated in FIG. 3. The housing includes a plurality of arcuate support bands 60 that are embedded in the housing and are spaced apart from each other along the longitudinal centerline of the housing, abnd the short leg is trapped between at least some of these straps and the remainder of the central section to be held in place. One end of the short leg 58 is connected to a bight section 64 that extends downwardly toward the plane containing the wing section long legs and on the longitudinal centerline 48. A long leg 66 extends along the longitudinal centerline 48 and is connected at one end thereof to the bight section and has a second end 68 located outwardly of the central section beyond the end 34. The long leg 66 is spaced above the plane containing the long legs 44 to be located inside the housing central section.

A paint roller 70 is rotatably mounted on the roller support long leg 66 and is dimensioned to have a surface extend beneath the plane containing the wing section long legs 44 whereby the roller can have paint applied thereto and can then roll to apply that paint to a surface. A suitable lock 72 can be releasably mounted on the end of the roller support long leg to keep the roller 70 in place on that long leg.

The roller can be easily removed for cleaning or replacement, and the housing will protect the user's hands and fingers from paint as the wing sections act as finger and hand guards. The user grasps the housing near the area identified in FIG. 2 by the reference numeral 76, with his fingers located adjacent to one wing section and the heel of the hand located adjacent to the other wing section so the housing lies crosswise in his hand. The applicator is manipulated by moving the housing, and paint is applied to and by the roller.

The applicator 30 is preferably made of plastics-type material that can be cleaned and will not be damaged by the paint or other substances with which it will be used.

It is understood that while certain forms of the present invention have been illustrated and described herein, it is not to be limited to the specific forms or arrangements of parts described and shown.

I claim:

1. A roller-type paint applicator comprising:

(A) a monolithic housing which includes (1) two L-shaped wing sections each having a short leg and a long leg, first and second ends, with said wing section long legs being coplanar with each other and which extend toward each other and are both interposed between said short legs, and (2) a semicylindrical central section having a longituidinal centerline located intermediate to said short legs and said long legs and having two side edges each of which is connected to one of said long legs and first and second ends which are coplanar with said wing section first and second ends;

(B) a plurality of arcuate support bands embedded in said central section and being spaced apart from each other along said central section longitudinal centerline; and (C) a monolithic J-shaped roller support element which includes (1) a short leg attached to said central housing by being interposed between said support bands and said central housing and having one leg that extends beyond one of said central ends, said short leg extending along said longitudinal centerline, (2) a bight section having one end attached to said short leg and extending from said short leg toward the plane containing said wing section long legs, and (3) a long leg extending along said central section longitudinal centerline and having one end connected to said bight section and having another end spaced outwardly of said central section beyond the other end of said central section, said long leg being spaced above the plane containing said wing section long legs; and (D) a paint roller applicator mounted on said roller support long leg, said roller applicator being sized to extend outwardly of said central section below the plane containing the wing section long legs and to be spaced from said central section.

* * * * *